US006123680A

United States Patent [19]

Brummer

[11] Patent Number: 6,123,680

[45] Date of Patent: Sep. 26, 2000

[54] CENTRIFUGAL FORCE DEVICE AND METHOD FOR TREATMENT OF ORTHOPEDIC SPINAL DISORDERS

[76] Inventor: Eric Brummer, 67 Jefferson Ave., Jersey City, N.J. 07306

[21] Appl. No.: 09/061,501

[22] Filed: Apr. 16, 1998

[51] Int. Cl.[7] ..... A61H 1/00

[52] U.S. Cl. ..... 601/5; 602/35; 601/84; 601/86; 606/242; 606/243

[58] Field of Search ..... 606/241, 242, 606/243, 244, 245; 601/84–87, 5, 23–26; 5/610, 611, 607, 608, 108, 109; 472/27–30, 33, 35, 44; 482/144, 134, 142; 602/32, 33–35, 36

[56] References Cited

U.S. PATENT DOCUMENTS

| | | | |
|---|---|---|---|
| 735,141 | 8/1903 | Ogle | 601/5 |
| 1,925,180 | 9/1933 | Eyerly | 472/33 |
| 3,034,152 | 5/1962 | Stryker | 5/610 |
| 3,276,777 | 10/1966 | Pruitt, Sr. | 482/33 |
| 3,388,700 | 6/1968 | Mountz | 601/5 |
| 3,581,739 | 6/1971 | Brandt et al. | 601/5 |
| 3,752,153 | 8/1973 | Copeland | 606/242 |
| 4,205,665 | 6/1980 | Burton | 602/35 |
| 4,402,500 | 9/1983 | Coles | 472/33 |
| 4,898,377 | 2/1990 | Roche | 472/35 |
| 4,907,571 | 3/1990 | Futakami | 601/5 |
| 5,094,249 | 3/1992 | Marras et al. | 601/5 |
| 5,395,290 | 3/1995 | Knijpstra | 472/31 |
| 5,885,197 | 3/1999 | Barton | 482/144 |

*Primary Examiner*—Richard J. Apley
*Assistant Examiner*—Justine R. Yu

[57] ABSTRACT

A centrifugal force device and method for treating neck and back pain associated with intervertebral disc disorders is described. The patient is secured to a table in vertical position with the table being oriented about its vertical axis so as to maximize the delivery of centrifugal force along an appropriate vector. The patient is then rotated about the vertical axis of the device in a speed and time duration controlled manner so as to subject the patient's spinal column to a predetermined level of centrifugal force. Under these conditions intervertebral discs and/or disc material pathologically displaced in a manner to cause the patient signs or symptoms will be forced away from the pathological positions within the spinal column toward a more desirable position as determined by an appropriate clinician. The table can be made with a top section movable upwards in relation to a fixed bottom section. A pulley and cable system and movable weights within the device cause the top section of the table to move upwards due to centrifugal force. Standard pelvic and occiput-chin harnesses attached to various parts of the table and/or patient and the pulley—cable—weight system permit adding lumbar-sacral or cervical traction forces simultaneously with centrifugal force to ameliorate disc derangements.

6 Claims, 10 Drawing Sheets

Non-Operational Postion

Operational Postion

Underside of Table 100

Diagram of sliding weight stack & cable system

CENTRIFUGAL FORCE DEVICE AND METHOD FOR TREATMENT OF ORTHOPEDIC SPINAL DISORDERS

BACKGROUND

This invention relates to the treatment of orthopedic spinal disorders, and in particular to the use of centrifugal force to ameliorate intervertebral disc associated pathology.

The human spinal column consists of 26 bony segments and 23 intervertebral discs (IVDs). From top to bottom, the spine consists of 7 cervical vertebra, 12 thoracic vertebra, 5 lumbar vertebra, the sacrum which is 5 vertebra fused together, and the coccyx which is several vertebra fused together. Each of the bony segments except the first two (C1 and C2) and the last two (sacrum and coccyx), are separated from each other by an IVD. The IVDs are cartilaginous and are comprised of an outer annulus fibrosis and an inner nucleus pulposus. The annulus is a cartilaginous disc and the nucleus is a semisolid gelatinous material situated within the annulus at the center of the disc. Because the IVDs are somewhat flexible, they give the spine mobility. They also attenuate force when external loads are placed on the spine.

Acute or chronic injury to the IVD, can result in severe neck, back or limb pain, necessitating medical intervention. If a disc or disc material deviates from its proper position centrally between the vertebral bodies to a more posterior position it can encroach on the spinal canal. The annular or nuclear material can press against and cause irritation of several tissues, including the spinal cord, spinal nerve roots, and the posterior longitudinal ligament. Also, because the annulus fibrosis is innervate with pain fibers, it can be a source of pain as a result of tearing, bulging, or herniation. If disc material presses against the cord or spinal nerve roots, a radiculopathy may result, which may cause signs and/or symptoms to be experienced somewhere along the distribution of the involved neural tissue.

Various treatment modalities are available for patients suffering from IVD related pathology. These include: bed rest, analgesics and anti-inflammatory medication, physical therapy, spinal manipulation, and traction. If conservative measures fail, surgical intervention may be indicated. Surgery on the spine can be very complicated and is not always successful. This has led to the syndrome known as "failed back surgery". While present treatments can provide relief in a large numbers of cases, there is obviously a need for more effective methods for dealing with these problems. The present invention discloses a device and method for applying controlled centrifugal force to the spinal column in order to reposition displaced IVDs back into a more normal position, and thereby relieve patients of associated signs and symptoms. In addition, lumbar-sacral or cervical traction features can be employed at the same time to further increase the reduction capacity of the device.

It is therefore a primary object of the invention to provide a novel device and method for alleviating patient signs and/or symptoms due to intervertebral disc associated pathology.

A further object of the invention is to provide a device and method for applying controlled centrifugal force to the spinal column.

An additional object of the invention is to provide a device and method for applying controlled centrifugal force to a patient's spinal column, the centrifugal force being specifically tailored to each individual patient's intervertebral disc pathology.

Still another object of the invention is to provide a device and method for positioning said patient so that the force vector of the centrifuge can be specifically tailored to each individual patient's pathology.

Yet another object of the invention is to provide a device and method for simultaneously combining lumbar-sacral traction with controlled centrifuigal force.

A further object of the invention is to provide a device and method for simultaneously combining cervical traction with controlled centrifugal force.

SUMMARY

The above and additional objects are accomplished with the centrifugal force device and method for intervertebral disc disorders envisioned by the instant invention.

Posterior derangement is a common and often serious spinal disorder. It pertains to displacement of the intervertebral disc from its proper position centrally between the vertebral bodies to a more posterior position encroaching on the spinal canal, resulting in the above mentioned pathologies. Systems have been devised for the differential diagnosis and treatment of back pathology. Current medical thinking often advises treating posterior derangement through extension. For example, a prone press up is one exercise utilized to centralize a posterior derangement. It is hypothesized that the forces imparted on a posterior disc during spinal extension movements can help move it anterior. The prone position is also used to reduce disc derangement. In this position gravitational forces pull the disc anterior.

Spinal traction is a common form of therapy for people suffering from back pain and associated limb pain (radiculopathy). It is often employed by clinicians to treat herniated discs or bulging discs. It has been proven through scientific research that traction forces can at least temporarily reduce disc bulging. As the vertebra are separated the intra-discal pressure is reduced. Disc material is drawn centrally to the area of low pressure. This moves bulging and herniated disc material away from their pathological positions within the spinal column toward a more central position between the vertebral bodies.

This invention is unique because it utilizes a new method to treat spinal, neck and back pain, and radiculopathy associated with disc pathology. The invention is a large centrifuge that can spin a patient and exert centrifugal forces to shift the intervertebral disc or disc material in a predetermined direction.

The patient is placed prone on a table or platform. The table is horizontal in the starting position and can be rotated about an x axis relative to the table up to a vertical position. The vertical position is used during operation. To reduce construction cost, it is possible to use a table or any such platform that is fixed in the vertical position.

The table is attached to a motor or any such power source by a lever. The lever can be constructed of any material of sufficient strength capable of withstanding the forces exerted on it. The length of the lever is dependent on the power source. The combination of power source and lever length must be capable of generating appropriate G force. The motor can be gas, electric, or any such power source capable of spinning the patient at appropriate speeds to develop the desired G force. G force range should extend from 0 at standing still to a level close to the limits of human tolerance.

Once the patient is in place and in the operational position, the motor is turned on and the patient is spun in a circle. For posterior derangement, the patient's back will face the center of rotation. The centrifuge will exert a force directed away from the center of rotation, pushing the anterior surface of the patient into the table. It also pushes the nucleus of the intervertebral disc against the anterior annular wall.

The treatment can be tailored to suit each patient. The force can be altered by spinning the machine faster or slower. For discs with a lateral component the table is rotated about a y axis through the center of the table, in the vertical position, until the force vector is aligned with the axis of displacement of the disc. The table is then locked in place. In this position an anterior medial force can be used to shift disc material. It also possible to use the invention to reduce the less common anterior herniation. However, the patient would have to be oriented so he faces toward the center of rotation instead of away from it. This can be done by placing the patient with his back to the table instead of facing the table.

To increase the disc reducing capacity of the device, centrifugal forces can be combined with traction. Traction can be applied by a weight stack, hydraulic system, motorized system or any such method capable of exerting sufficient treatment force. The amount of traction should range from 0 lbs up to near the limits of human tolerance. The patient is fixed to the table and or traction mechanism with straps, belts, harnesses, or by any means capable of obtaining the desired position. The invention should prove effective on cervical, thoracic and lumbar disc pathology.

Two versions of the invention are depicted on the following pages. The first version employs an anterior directed centrifugal force to treat spinal pathology. The second version uses centrifugal force with vector control in combination with traction to treat spinal pathology.

In a first version of the present invention centrifugal force is utilized to move a disc and/or disc material anterior. The patient is placed in a horizontally configured centrifuge of standard design except, of course, for the large dimensions required. This version of the centrifugal device of the invention is approximately 12 feet in diameter. A room to accommodate the device would have to be approximately 17 feet in length by 13 feet in width. The centrifugal device has a variable speed motor housed in a center column supporting a horizontally positioned frame to be rotated about the center column. A table at one end of the frame supports the patient to be treated, and an adjustable weight at the opposite end of the frame compensate for the weight of the patient and the patient's supporting structure.

To use the centrifugal device, the patient is placed prone on the table. The table has a soft surface and a face cut out to allow the patient to breath freely. The patient's feet rest securely on an adjustable foot plate, with the patient being instructed to grasp adjustable hand pegs located at the left and right sides near the top of the table. In the starting position the table is horizontal. The patient's feet point to the center of the centrifuge and the patient's head points to the perimeter. The patient is strapped onto the table. The table is then rotated from horizontal to vertical. At this point the patient's back faces the center of the centrifuge.

Once the patient is positioned correctly, the centrifugal device is turned on and the rotational speed adjusted. Centrifugal forces press the patient's ventral surface against the table. The centrifugal force will push the nucleus of the intervertebral disc directly away from the center of rotation against the anterior annular wall. Speed duration and frequency parameters will be developed, of course, in response to the requirements of each individual patient.

A second version of the invention is similar to the first except it incorporates two additional features. These features are precise force vector control, and simultaneous combination of centrifugal force with traction force.

In this second version the patient securing table can rotate 180° about a y axis through the table. This feature enables the operator to choose the appropriate force vector. In this manner, discs having a lateral pathological component can be successfully treated by having the table (and patient) rotated a predetermined amount of degrees clockwise or counter clockwise about the y axis of the table. For example, rotating the patient's right lateral side toward the center of rotation will force the discs to the left and could be used to treat discs that are displaced to the right. It should also be possible to position a patient with his or her back to the table instead of facing the table in order to treat the less common condition of anterior herniation.

The rotational capacity of the table is accomplished by the addition of a circular frame to house it. The circular frame rotates about an x axis which enables the table to be positioned from horizontal to vertical. In addition, the table can be rotated about a y axis within the circular frame which allows for force vector control.

In addition to precise force vector control, this second version of the invention provides for combining centrifugal force with traction for lumbar, thoracic, and cervical disc pathology. The table is split approximately at its middle dividing it into upper and lower halves (A third version of the machine would incorporate a cervical split in the table for use with cervical traction).

In this second version of the invention, traction is applied through a sliding weight stack situated on the horizontal frame, at the opposite side of the frame as the table. The weights can be fixed to the frame with a pin, Depending on the placement of the pin, any or all of the weights can be fixed while those not pinned are free to slide. The sliding weights are attached to a cable. The cable is attached to the top portion of the table when it is in the vertical operating position through to two pulleys. When the centrifuge is turned on, the weights that are not pinned will be forced away from the center of rotation. The weights will pull against the cable and separate the top and bottom sections of the table through the pulley system. Because the patient is attached to the table with harnesses, spinal traction will occur with the separation of the two halves of the table. Traction force is determined by the amount of sliding weight in combination with the speed of rotation of the centrifuge. A simple calculation is all that is required for the operator to choose the appropriate weight selection relative to the predetermined treatment speed of rotation. A detailed description on how to use this second version of the invention is provided in the section labeled "Detailed Description".

The axis of rotation of the centrifuge in the first and second versions of invention is along a y axis relative to the ground. This axis can be considered a line that runs through the center of crossbars 52 in diagram 7. The axis is referred to as a first vertical rotational axis. The rotational axis of the centrifuge is situated some distance away from the table and the patient secured to the table. The appropriate distance between the table and the rotational axis of the centrifuge should be determined through proper research.

Considering the patient securing table described as analogues to a plane as described in any plane geometry text, it would have a, y table axis, which would run along the long axis of the table and separate the table into right and left rectangular portions. The patient securing table would have an x table axis, which separates it into upper and lower portions. A z table axis, would penetrate the table surface at a right angle. The patient is secured to the table in the approximate anatomical position.

When the table is in it's operational vertical position, in either the first or second versions of the invention, its y axis is perpendicular to the ground and parallel with the axis of rotation of the centrifuge. In this position the y axis of the table forms a second vertical axis. The axis of the table is referred to as a second vertical axis. The x axis of the table forms a non intersecting perpendicular line to the rotational axis of the centrifuge. In the standard operational vertical position, a z table axis would form the shortest straight line from the table, to the axis of rotation of the centrifuge. With the table in the standard vertical position, the center of the table along its vertical axis lies closest to the axis of rotation of the centrifuge.

In the second version of the invention the table can be rotated about its own vertical axis (now altered from its standard vertical position), in a clockwise or counterclockwise direction, viewed from the top. If rotated in a clockwise direction the right surface of the table moves closer to, and the left surface moves further from, the axis of rotation of the centrifuge. The table's own vertical axis is referred to as a second vertical axis in the claims.

In both versions of the invention the table can be rotated about an x axis through the approximate middle of the table. This is to allow the table to begin in a horizontal position with the ground, to secure the patient, then rotate up to a vertical position before the start of treatment. After treatment the table may be brought back to the horizontal position to allow the patient to lie for a period of time to recover from the dizziness and other side effects experienced as a result of the treatment.

All rotation of the table about the table's own axis are done before and after the start of treatment. The start of treatment being defined as the moment the centrifuge is turned on. All rotations of the table about its own y and x axis are done to select the appropriate table position during treatment.

In both versions of the invention the table is locked in place in a vertical position about its own x axis before the centrifuge is turned on. In the second version of the invention, the table may be locked in any of a multitude of positions about its own y axis (second vertical axis) before the. centrifuge is turned on.

In the second version of the invention, positioning of the table in clockwise or counter clockwise rotation relative to it's vertical axis is accomplished by use of a pinning system To lock the table in a predetermined about it's y axis a pin is placed through any of several holes in the outer table frame hoop through a hole in the inner table frame hoop.

In either version the table does not rotate about any of its own axis while the centrifuge is running. The positioning of the table about its own y and x ass are performed to control the force vector of the centrifuge relative to the table and thus relative to the patient as well When the centrifuge is turned on, the table rotates about the axis of the centrifuge (not about any of its own table axis) which is situated some distance away from the table. The axis of tee centrifuge as depicted in the diagrams is a vertical line through the center of crossbars 52 as shown in diagram 7. One revolution of the table about the centrifuge rotational axis will describe the circumference of a circle.

The force vector of the centrifuge is always parallel with the ground. It is always from the center vertical rotational axis of the centrifuge along a, z x plane, outward. In relation to the circle traveled by the table, the instantaneous centrifugal force vector will be along a radius drawn from the axis of the centrifuge toward the circumference of the circle. Alterations in the centrifuigal force vector are only in relation to the table and thus patient. Alterations in the force vector relative to the table are accomplished by the particular table position, which is chosen and secured before the start of treatment. The start of treatment being defined as the moment the centrifuge is turned on.

In the standard vertical position of the table, the force vector of the centrifuge would be approximately along the transverse plane (x z plane) of the patients The centrifugal force would occur along or very close to a z axis relative to the table. The force would be directed from posterior to anterior relative to the patient. This is assuming the patient's anterior surface is facing the table. This table position would be appropriate for a direct posterior derangement For effective treatment of orthopedic spinal syndrome, it may be necessary to apply force in the, z x plane, along a z axis, because the intervertebral disc is located close to the, z x plane. Most disc displacements occur close to this plane, in the posterior, or posterior lateral (back and to the side) direction.

In the second version of the invention the table can be rotated clockwise or counter clockwise, as viewed from the top, about a y axis bisecting the table into right and left halves. If the table were rotated clockwise, then the right surface of the table would be positioned closer to, and the left surface further from the centrifuge axis. This position is secured, and locked in place, before turning on the centrifuge. This would alter the force vector of the centrifuge relative to the table and patient. The force vector of the centrifuge would still occur in the transverse plane ( x z plane) of the patient However, now the centrifugal force would run along an axis somewhere between a, z axis, and an x axis, relative to the patient. The exact angle of the force is dependent on the degree of vertical axis table rotation chosen and secured prior to the start of treatment. The force vector would now have a right to left component as well as a posterior to anterior component, relative to the patient. This table position could be used for the treatment of a posterior lateral right disc derangement, to shift the displaced material anterior and left, toward its proper position between the vertebral bodies. For the treatment of a posterior left disc derangement, everything should proceed as described above, except the table would be rotated counter clockwise about its y axis instead of clockwise with the left side of the patient closer to the centrifugal axis of rotation prior to the start of treatment.

DETAILED DESCRIPTION

Figure 1:
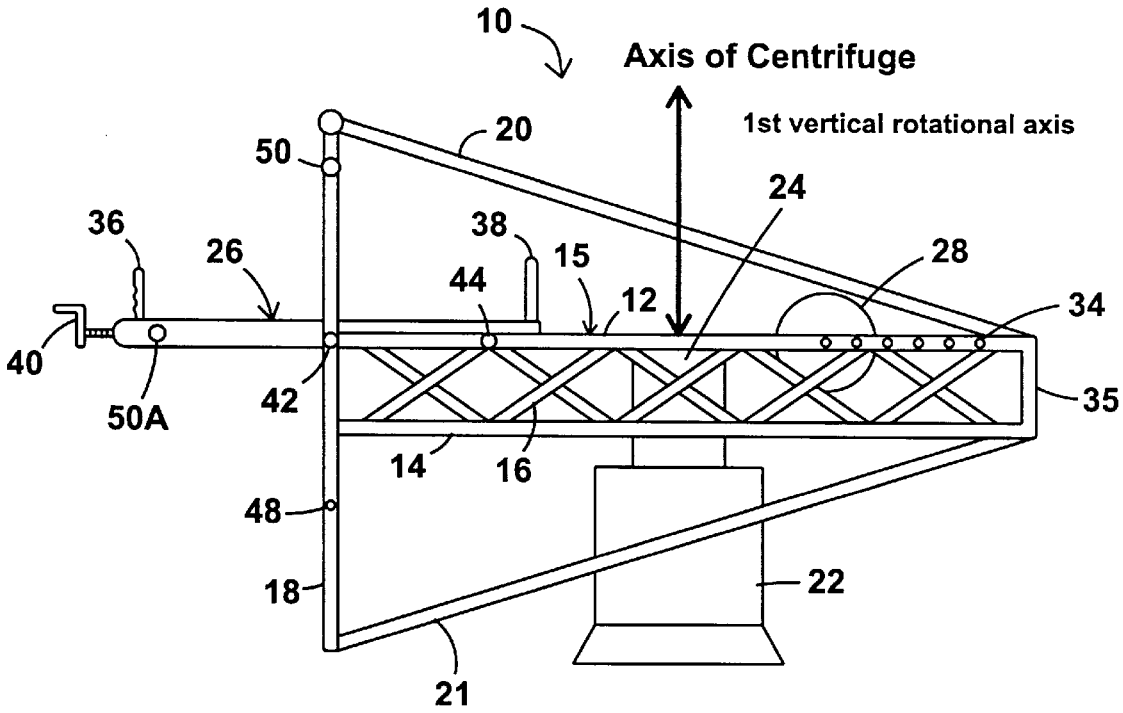
FIG. 1 is a side schematic view of a first version of the centrifugal force device of the invention showing a horizontal support structure with a patient securing table extended in a horizontal position.

Not shown in the drawings is the spinning shaft of motor 24. The spinning shaft projects from the top of the motor. It is coupled to crossbars 52. The spinning shaft of the motor defines the rotational axis of the centrifuge. The rotational axis of the centrifuge is a perpendicular line through the center of crossbars 52.

Drawing Corrections

Please omit all drawings submitted in the response to the first detailed action. Replace them with the drawings submitted in the original application with the following exceptions.

FIG. one is resubmitted showing a first vertical rotational axis (centrifugal axis). The addition is drawn in red.

FIG. seven is resubmitted showing a first vertical rotational axis (centrifugal axis) and second vertical axis (y axis of table in vertical position). The addition is drawn in red.

Turning now to the drawings wherein similar structures having similar functions are given the same numerals, in FIG. 1 a first version of the centrifugal force device of the invention is depicted. The device consists of a centrally positioned support column 22 supporting a horizontally positioned support girder 15. The support girder has two parallel left and right side horizontal top members 12, two parallel left and right side horizontal bottom members 14, with cross bars 16 connecting the top and bottom sides together to form the support girder 15. The rear end of the support girder 15 is formed by two support bars 35, placed perpendicular to the girder side members, connecting the top and bottom side members together, and two additional support bars 35A (FIG. 3 & 3A) connecting the two top side members together and the two bottom side members together. The front end of the support girder 15 has two vertically positioned bars 18 affixed to it, one on each side of the girder. The vertically positioned bars 18 each have a connecting rod 20 joining the top of each vertically positioned bar to the rear end of the girder, and a second connecting rod 21 joining the bottom of each vertically positioned bar to the rear end of the girder.

A patient securing table 26 is shown in horizontal position, connected midway along its length by a pair of pivot bars 42 interconnecting the vertically positioned bars 18 and the patient securing table at both the left and right sides of the table through apertures 42A in the sides of the table. Approximately half of the table 26 extends forward of the vertically positioned bars 18 with the other half of the table extending between the top and bottom horizontal sides of the support girder. An aperture 44 in both of the top horizontal sides 12 of the girder matches apertures 48A in both sides of the table for the placement therein of a coupling pin 32 (FIG. 2A) so as to lock the patient securing table 26 in the horizontal position.

At the other end of the support girder 15, opposite the patient securing table, a weight 28 (FIG. 2A) is positioned between and affixed to the top horizontal side members 12 of the girder. The weight has a pair of connecting rods 30 at either end for insertion into one of a series of apertures 34 in both of the top horizontal side members. The weight is further secured by placement of coupling pins 32 into the top side aperture 34 and over the connecting rods 30 on the weight. The series of apertures 34 for the weight are to provide compensating adjustment for the differing weights of different patients to be positioned on the securing table. A variable speed motor 24 is affixed on top of the device support column 22, being secured to the support girder 15 by cross bars 52 (FIG. 3 & 3A). A speed control box (not shown) provides for operator adjustment of the speed of the motor utilizing, for example, a rheostat (not shown) to control motor speed, and hence the R.P.M.'S of the centrifugal force device 10.

Figure 2:
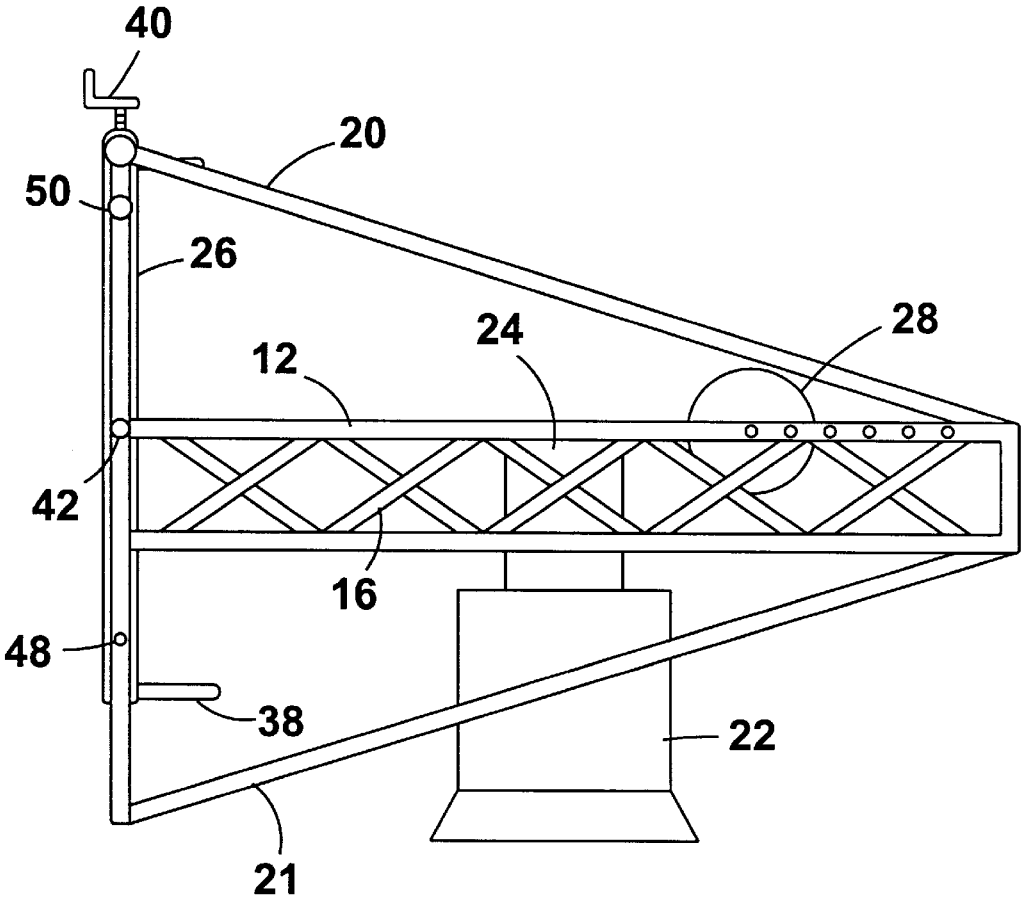
FIG. 2 is a side schematic view of the version of the invention of FIG. 1 shown with the patient securing table in a vertical position.

In FIG. 2, the patient securing table 26 is shown as being moved from its initial horizontal position (FIG. 1) to a vertical position relative to the support girder. To accomplish this the coupling pins 32 securing the table to the top horizontal side members of the girder would be removed and the table pivoted about the pivot bar 42 to reach the vertical position. Coupling pins 32 would then be inserted into apertures 48 and 50 in the vertically positioned bars 18 and into matching apertures 48A and 50A in the patient securing table so as to secure the table in the vertical position.

Figure 2A:
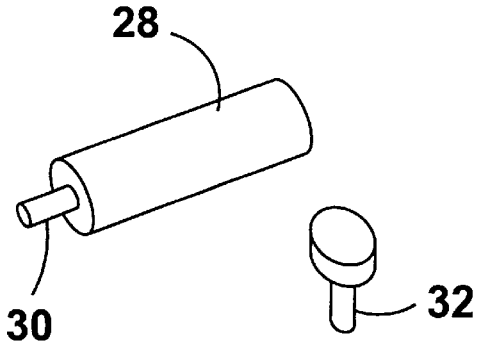
FIG. 2A is a schematic perspective view of the patient compensating weight, and the coupling pin of the version of the invention depicted in FIG. 1.
Figure 3A:
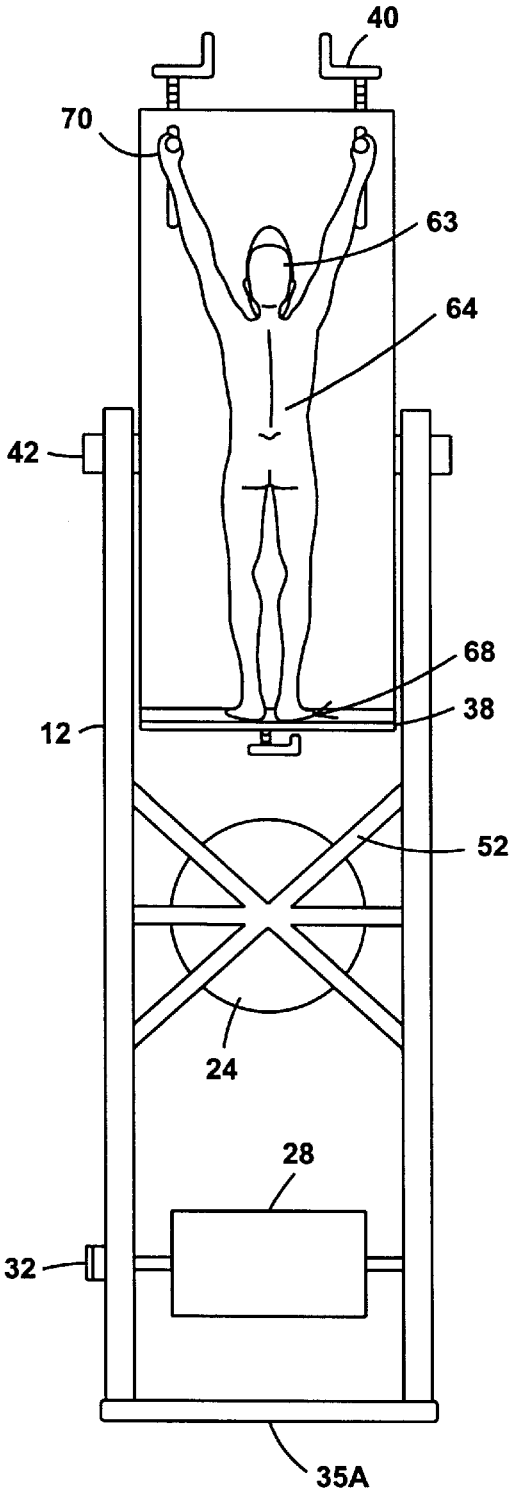
FIG. 3A is a schematic view similar to that of FIG. 3, showing a patient in position on the horizontally positioned patient securing table.
Figure 3:
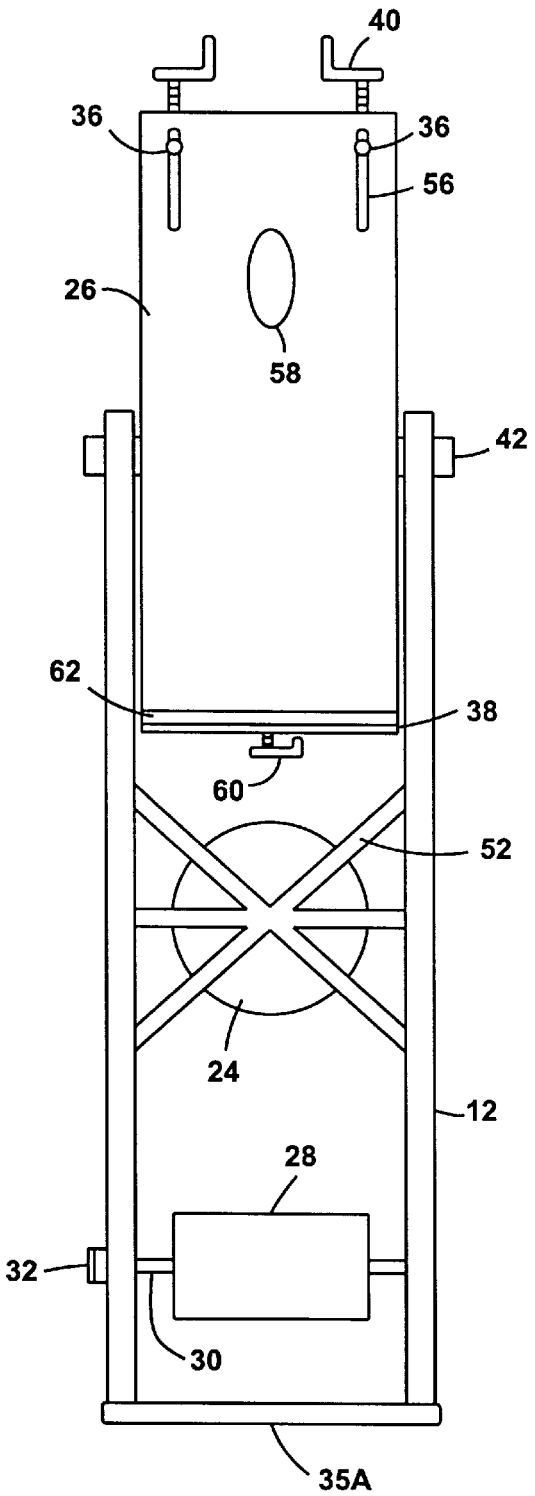
FIG. 3 is a top plan schematic view of the horizontal support structure and horizontally extended patient securing table depicted in FIG. 1.

FIG. 2A is a perspective view of the patient compensating weight 28, and the coupling pins 32 employed to secure the weight and other components of the centrifugal force device.

FIG. 3 is a top plan view of the patient securing table as connected in the horizontal position to the support girder, minus the vertically positioned bars 18 and their connecting rods 20. The patient securing table 26 has an adjustable patient foot support 38, and adjustable patient hand grips 36, and a face cut out 58 to permit comfortable breathing during treatment. As best seen in FIG. 3A, the patient 64 is secured to the horizontally positioned table with his or her feet 68 resting on the foot support 38, and with his or her left and right hand 69 grasping the respective hand grip. The patient faces the breathing opening 58 in the table. The hand grips 36 are adjustable up or down using the hand grip hand crank 40 which moves the hand grips within slots 56 to adjust for the height of different patients. Similarly the foot support is movable up or down within slot 62 utilizing the attached foot support hand crank 60.

Figure 4A:
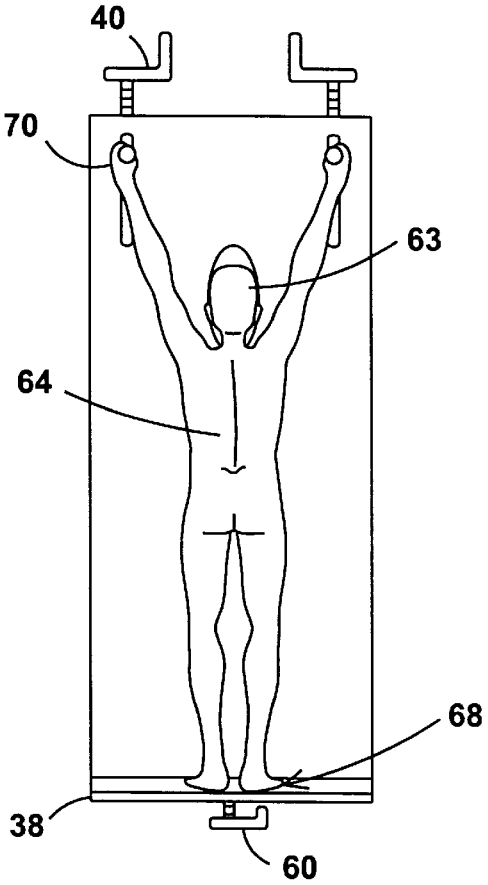
FIG. 4A is a view similar to FIG. 4 with a patient shown in place on the patient securing table.
Figure 4:
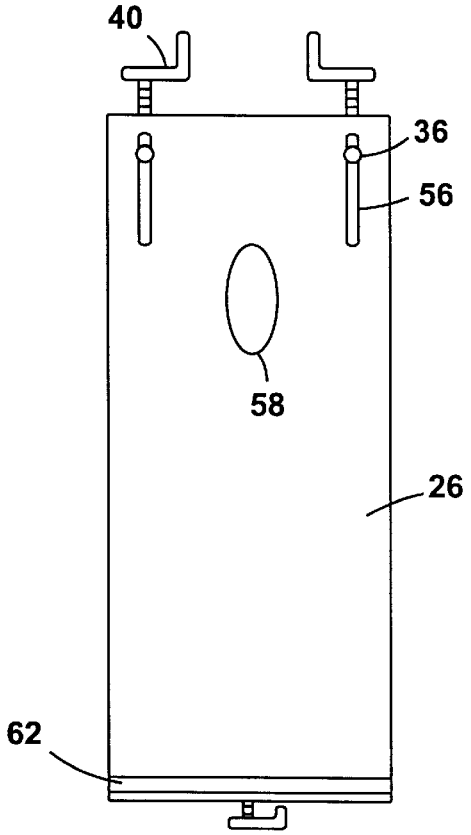
FIG. 4 is a top plan schematic view of a first version of the patient securing table of the invention.
Figure 4B:
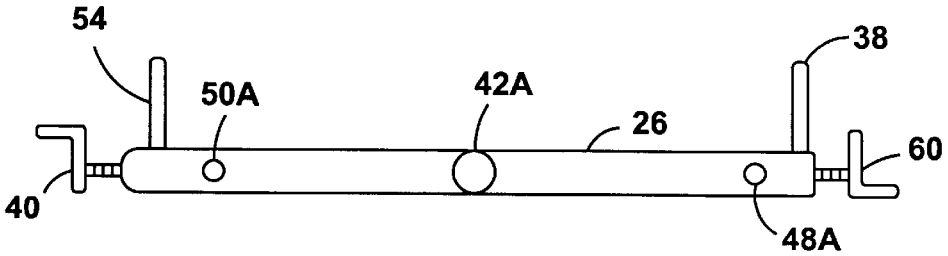
FIG. 4B is a side schematic view of a first version of the patient securing table of the invention.

FIGS. 4, 4A, and 4B depict the patient securing table independent of the centrifugal force device. To utilize the invention, the patient is initially positioned as shown in FIG. 3A with the patient securing table locked in the horizontal position. After the patient is firmly secured, the locking pin is removed and the table is pivoted to a vertical position as depicted in FIG. 2. The patient has his back facing the centrifuge motor 24. The centrifugal force device 10 is activated, speed of rotation is controlled at a predetermined setting, and the patient is rotated about the central axis of the device. Under these conditions centrifugal force is directed at the intervertebral disc pathology. This causes the disc and/or disc material to move anterior into a more central position between the vertebral bodies. Rotational speed, duration and frequency of the treatment are coordinated parameters set in response to the requirements of each individual patient.

Figure 5:
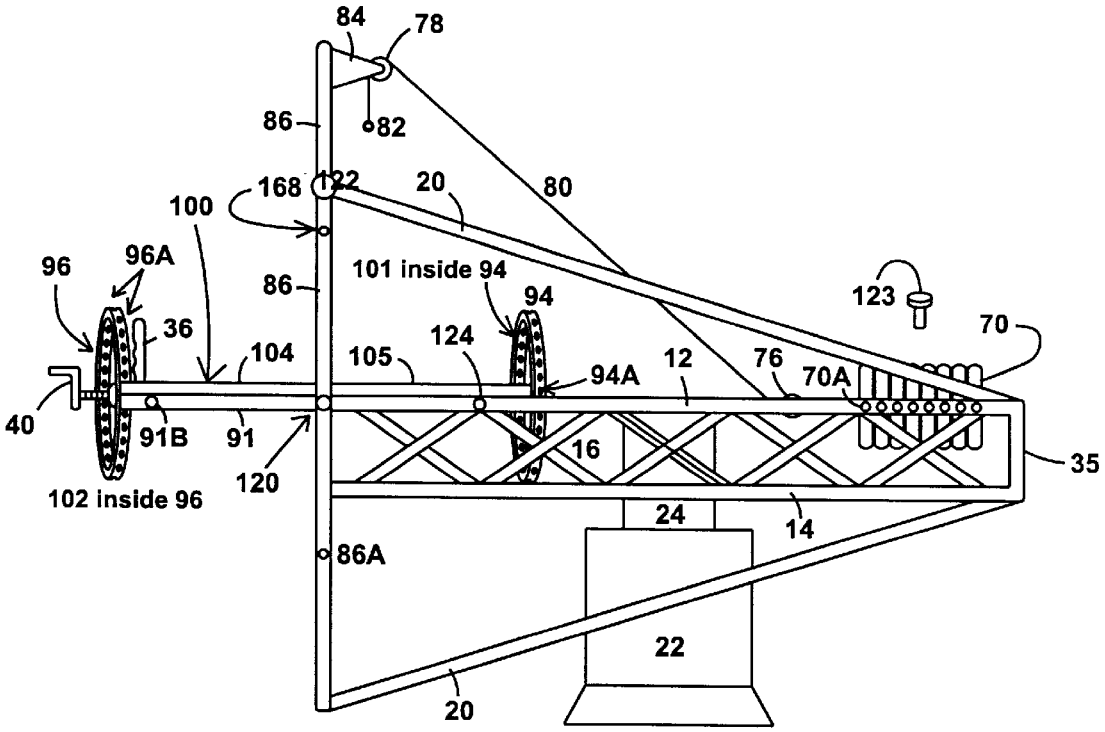
FIG. 5 is a side schematic view of a second version of the centrifugal force device of the invention showing a horizontal support structure with a patient securing table extended in a horizontal position.

FIG. 5 depicts a side view of a second version 11 of the invention which is basically similar to the first version centrifugal force device 10 except for modifications made to incorporate force vector control and traction. This second version 11 has the same motor 24, and speed control, the same centrally positioned support column 22, and the same support girder 15. At the front of the support girder 15 two modified vertically positioned bars 86 take the place of vertical bars 18 of first version. Vertical bars 86 are affixed at each side of the front end of the girder. The top of bars 86 are connected to each other by a cross bar 88 as seen in FIG. 7 & 8. There is a brace 84 to house a pulley 78 secured at the center of cross bar 88.

FIG. 5 shows a patient securing table, labeled 100 in this second version of the invention, in it's horizontal starting position. The table in this second version 11 of the invention differs from the table in version 10. Table 100 is split in the middle as seen in FIG. 9. The top half is labeled 104 and the bottom half is 105. The split allows the top and bottom to separate during traction.

The top section has the previously mentioned aperture 58 for the placement of the patient's face, and also patient hand grips 36 and hand grip hand crank 40 which moves the hand grips within slots 56. In addition the top section 104 has three loops, 104A, 104B and 104C, at the top. The center loop 104B is for the attachment to a cable and pulley system, the outer two loops are for the attachment of a thoracic harness.

The bottom section 105 of the table has the same adjustable patient foot support 38 as the table from the first version except that the foot support has two loops for attachment of the pelvic harness 145. The foot support is movable up or down within slot 62 utilizing the attached foot support hand crank 60 in the identical manner as the first version 10 of the centrifugal force device.

Table 100 is housed within a more sophisticated frame to allow rotation about its long axis for force vector control. This sophisticated frame is labeled circular table frame 90. The circular frame consists of two longitudinal bars 91 that are connected to each other by two hoops 94 and 96 disposed near respective ends of the table, as seen in FIG. 7. Table 100 is also attached to two round hoops 101 and 102. Hoop 101 is at the bottom of table 100 and hoop 102 is at the top. Hoops 101 and 102 of the table fit inside hoops 94 and 96 of the table frame. Hoops 102 and 101 can be seen in FIG. 9. These hoops make it possible to rotate table 100 along its longitudianl axis within the circular table frame 90.

Figure 10A:
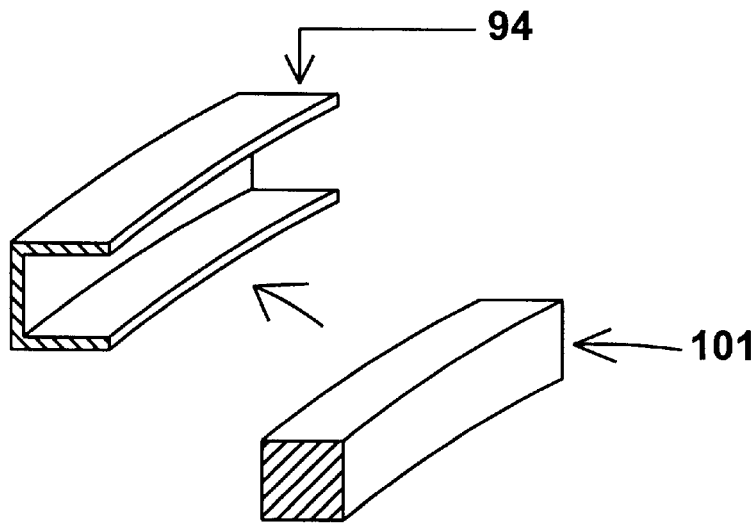
FIGS. 10A and 10B depict in schematic, perspective views segments of the loop portions of the circular frame structure of the invention.

FIG. 10A shows a typical construction for the complementing hoops. Hoop 94 and 96 would have a horse-shoe shaped cross-section. Hoops 101 and 102 would have a bar-shaped profile which permits nesting in the hoops 94 and 96 respectively.

Figure 10B:
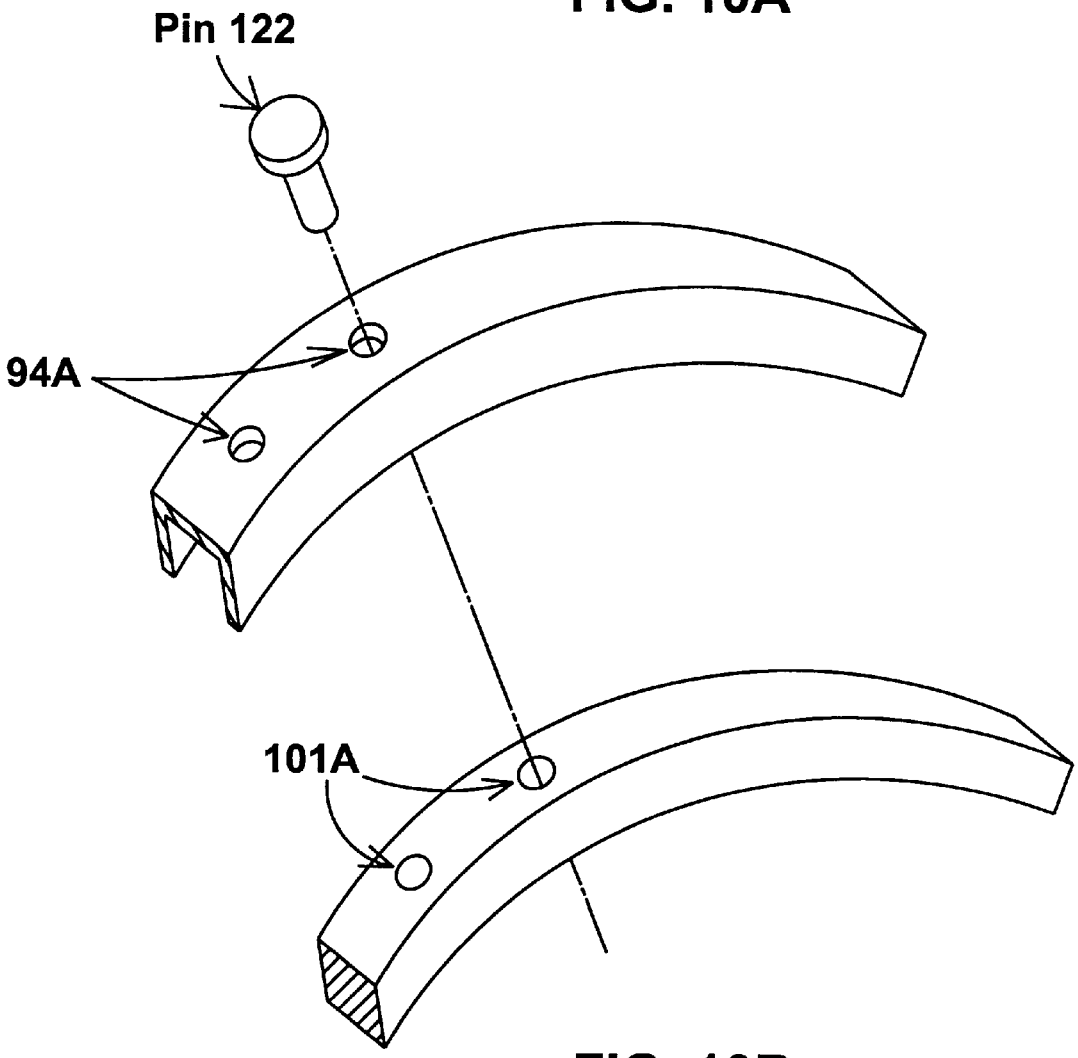

The table is secured in place by coupling pins 122 that insert through any of a series of apertures 94A (see FIG. 10B) and 96A in hoops 94 and 96 into apertures 101A and 102A in hoops 101 and 102. With these pins in place hoop 101 is locked to hoop 94 and hoop 102 is locked to hoop 96. This fixes table 100 in place at a selected degree of clockwise or counter clockwise rotation about its longitudinal axis within circular table frame 90.

Figure 6:
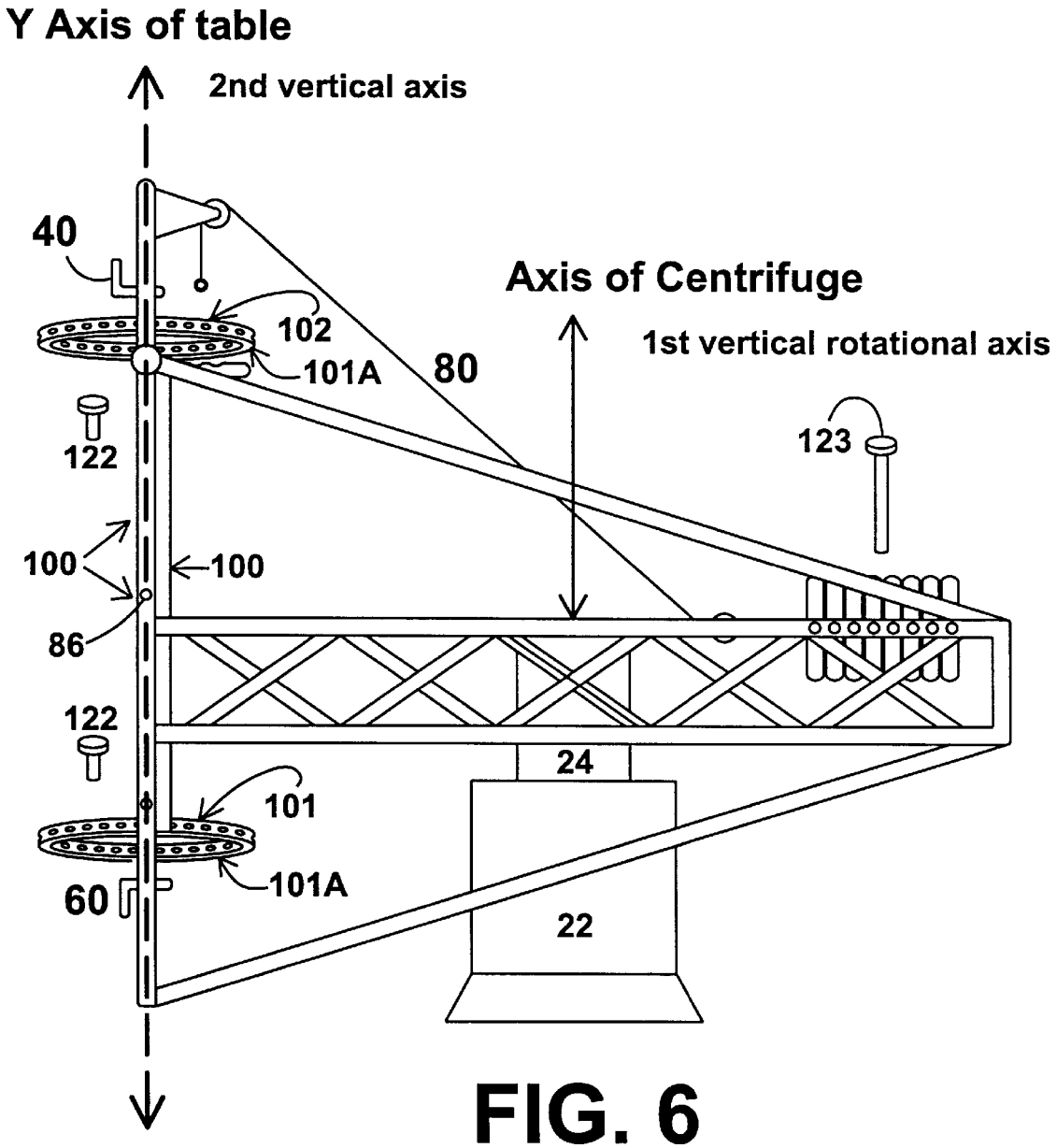
FIG. 6 is a side schematic view of the second version with the patient securing table in the vertical operational position with the circular frame removed.

In addition to rotating about its long axis within circular frame 90, table 100 also has the capacity to be brought from its horizontal starting position up to its vertical operational position (FIG. 6). This is accomplished by rotating circular frame 90 about an x axis by means of two round pivot bars 120. Pivot bars 120 attach the approximate center of longitudinal bars 91 of circular frame 90 to vertical bars 86.

Circular frame 90 can be locked in two positions, the horizontal starting position and the vertical operational position. Locking is accomplished by 4 coupling pins 122 that fit in aperatures. There is one aperture 12A in each of the two girders 12. There is a corresponding aperture 91A in longitudinal bars 91 of circular frame 90. Pins 122 fit through 12A into 91A locking circular frame 90 in the horrizontal position.

To lock circular frame 90 in the vertical position 4 aperture sets and 4 coupling pins 122 are used. There are two aperatures in each of the two vertical bars 86. There is an inferior aperature 86A which corresponds to aperature 91A in longitudnal bars 91 when circular frame 90 is in the vertical operational position. There is a superior aperature 86B in vertical bar 86 that corresponds to an aperature 91B at the superior end of longitudnal bar 91. Four coupling pins 122 fit through aperatures 86A and 86B into aperatures 91A and 91B locking circular frame 90 in the vertical position.

Figure 9A:
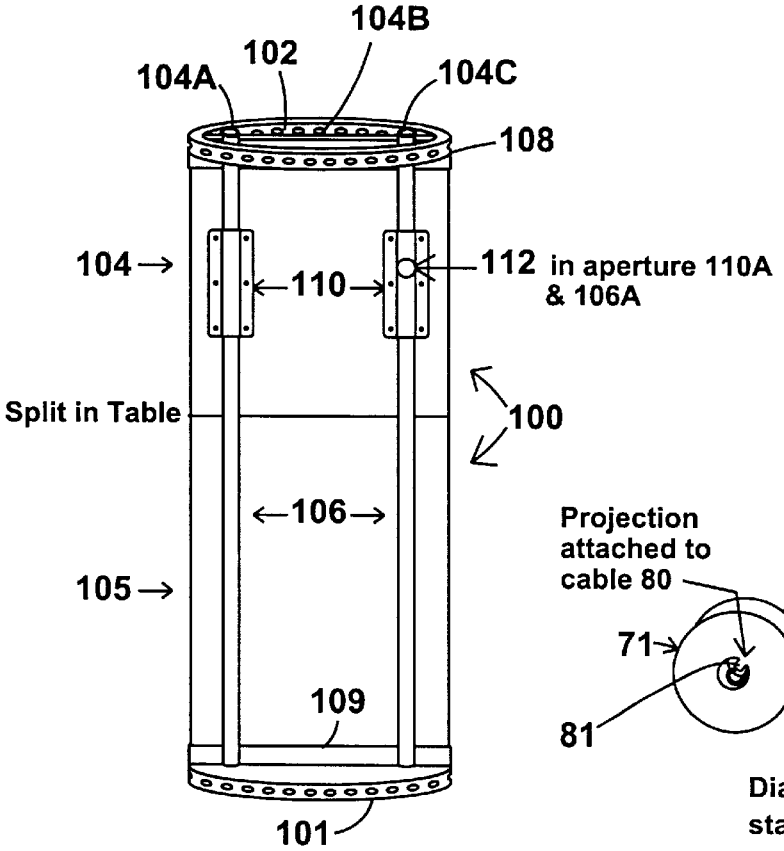
FIG. 9A is a schematic view showing the underside of the patient securing table.

As mentioned above table 100 is split at its center into an upper half 104 and a lower half 105. This is to enable 104 to separate from 105 during traction. This is accomplished through the use of two parallel bars 106 that run longitudinally beneath the underside of the table. Each bar is situated about half way between the midline and lateral edge of the table. Bars 106 are rigidly attached to 105 at the under side of table 100. They are also attached to two transverse bars 108 and 109 at the under side of the top and bottom of table. Transverse bar 108 attaches parallel bars 106 together and to hoop 102 at the top of table 100. Transverse bar 109 attaches the parallel bars 106 together and to hoop 101 at the bottom of table 100. This system of bars rigidly attaches table 100 to inner hoops 101 and 102. The top half 104 of table 100 is slideably secured to parallel bars 106 through a pair of matched sliding runners 110. These runners fit around parallel bars 106 and permit movement of 104 relative to 105 only along the axis of the bars 106 or y axis as defined above. This system allows 104 to slide up and down and separate from the fixed 105 during traction. A pin 112 is placed through apertures 110A and 106A in runner 110 and longitudnal bar 106 respectively to lock 104 in place if traction is not employed. FIG. 9A shows a diagram of the bottom of table 100.

Additional changes have been made in version 11 of the invention to provide a means of connecting a sliding weight stack 70 to upper section 104 of the patient securing table 100, or to the occiput chin harness 130, for lumbar and cervical traction respectively. The sliding weight stack is situated on a horizontal hollow weight bar 74 that is fixed between bar 35A and cross bars 52 (FIG. 7 &8). Each individual weight in the weight stack is disc shaped with a central hole that fits snugly over weight bar 74. Each weight also has an aperture 71A in its perimeter that corresponds to an aperture 70A in one of the horizontal bars 12. A pin 123 can be inserted through any of the apertures 70A in bar 12 into the aperture 71A of the corresponding weight. This pin is to lock the weight and all weights inwardly disposed from it, in place, so that during operation they do not contribute to the developed traction force. Pin 123 can be seen in diagram 7B.

The most peripherally disposed weight in the stack, labeled 71, has a slightly different form and function then the remaining weights in stack 70. Weight 71 is attached to a cable 80. When the traction feature of the invention is in use cable 80 connects sliding weight stack 70 through weight 71 to either top section 104 of the table at 104B, or to an occiput chin harness not shown, via clip 82. The cable will follow a path from its attachment to 104 or the occiput chin harness, over pulley 78, under pulley 76, inside weight bar 74, to weight 71. The attachment of cable 80 to weight 71 is to a small projection 81 in the weight that protrudes into a groove 74A along the upper surface of the weight bar. As the frame and table are rotated, centrifugal force causes the weights outboard of the pinned weight to move radially outward along bar 74 and provide traction at the opposite cable attachment. The number of weights disposed radially outward of the pinned weight and the rotational speed will determine the traction force. The weights that are free to slide will press against a spring 126 affixed to the horizontal rear connecting bar 35A of the girder in order to bias the free weights away from the rear of the girder and towards the pinned weights (see FIG. 7B). Spring 126 can be seen in FIG. 7.

Figure 7A:
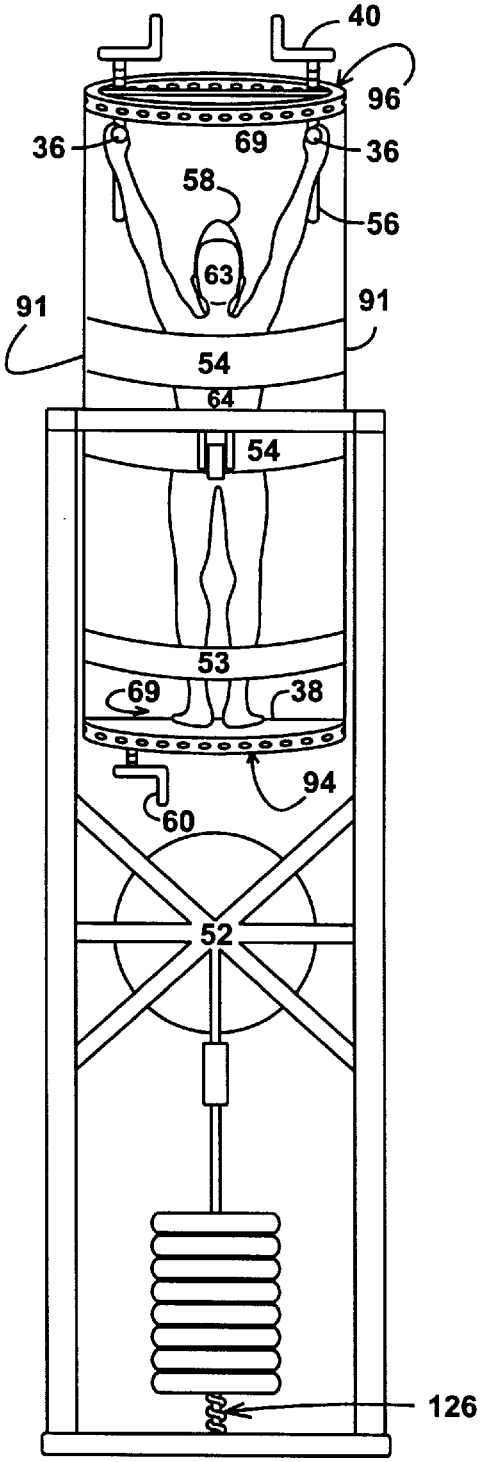
FIG. 7A is a top plan schematic view of the horizontal support structure and horizontally extended patient securing table depicted in FIG. 5, showing a patient in position on the horizontally positioned patient securing table with the patient secured to the table with straps.
Figure 7B:
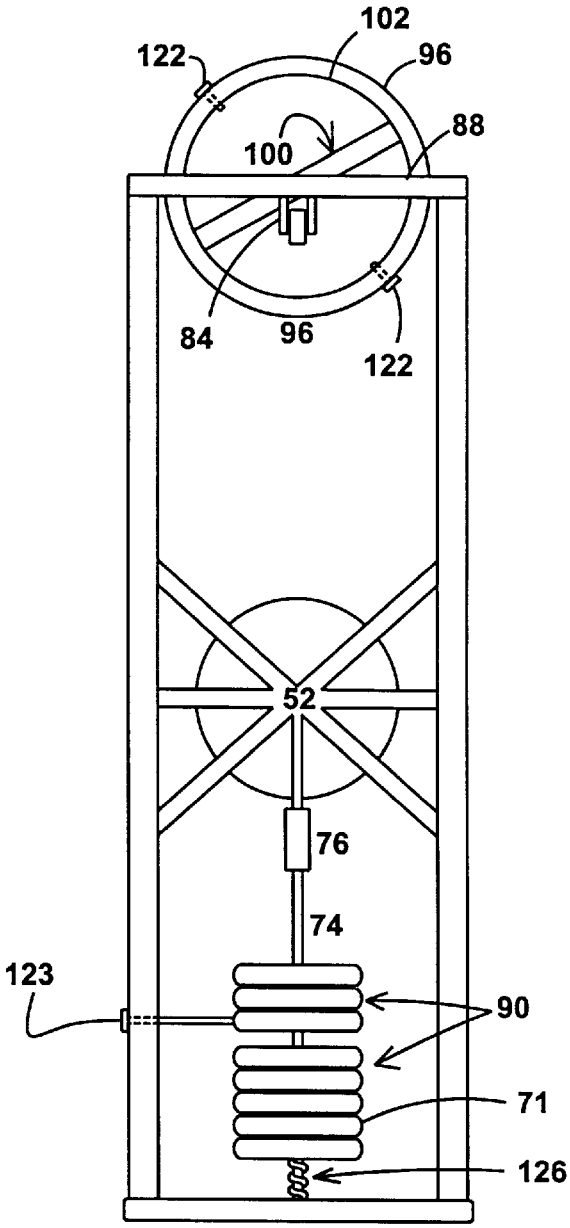
FIG. 7B is a top plan schematic view of the second version, however the table is in the vertical operational position.
Figure 8:
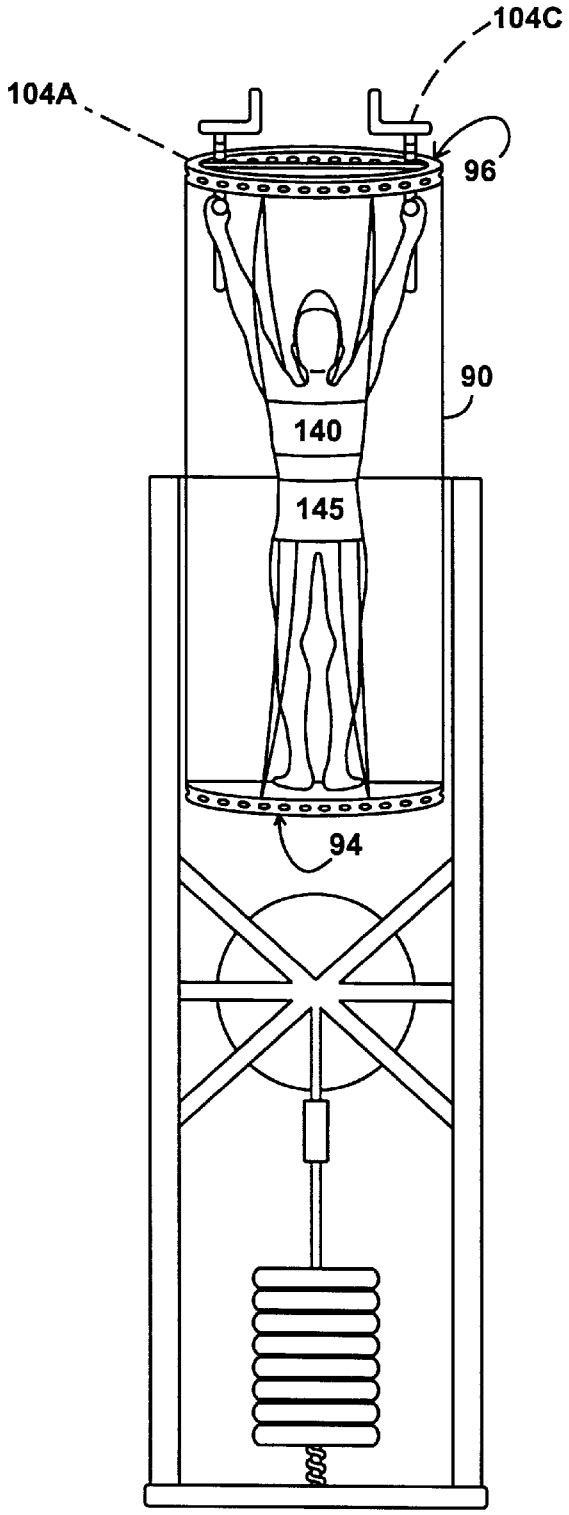
FIG. 8 is identical to 7A except obscuring structures have been removed to show the patient with thoracic and pelvic harnesses in place instead of straps.

FIG. 7A is a top schematic plan view showing a patient 64 as secured to the patient securing table by means of straps 54 and 55. FIG. 7A shows the table in its non operation starting position. FIG. 7B is a top view with the table in its vertical operational position without a patient.

FIG. 8 is the same as 7A except a thoracic harness 140 and pelvic harness 145 is shown securing the patient to the top section 104 and the bottom section 105 of the table respectively. The chest and leg straps have been omitted in this diagram. There are no diagrams showing an occiput chin harness. However, this harness is well known to the art and as mentioned above, would be secured by clip 82 to the cable 80 and the developed force provided by weight stack 70.

Figure 9B:
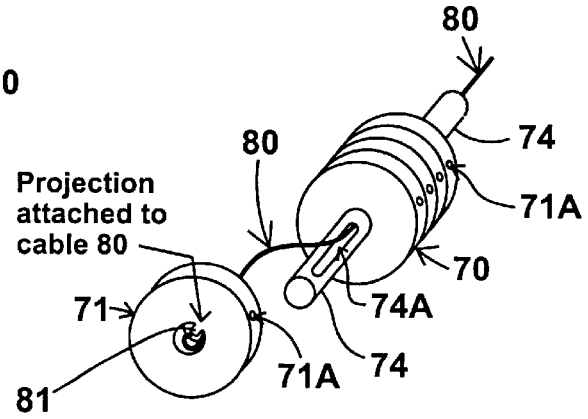
FIG. 9B is a schematic view showing a sliding weight stack, removed from the device, with the peripherally furthest weight removed from the stack.

FIG. 9A shows the bottom of table 100 including the two inner hoops 102 and 101 that fit inside hoops 96 and 94 of table frame 90. Also shown are the two runners 110 that connect the top section 104 to parallel bars 106 and enable section 104 to separate from 105. FIG. 9B depicts the weight stack 70 removed from the machine. Cable 80 can be seen passing inside weight bar 74. Weight 71 is shown removed from bar 74 to show how groove 74A allows cable 80 to connect to a projection 81 in weight 71. Fully assembled the projection in 71 fits in groove 74A so that 71 and the rest of the stack 70 outboard of the pinned weights in the stack can slide along weight bar 74 in response to centrifugal force.

The actual treatment of a patient utilizing this second version 11 of the centrifugal force device may proceed as follows: if lumbar traction is to be used the first step is to secure the thoracic harness 140 and pelvic harness 145 to the patient. The patient is secured to table 100 using strap 54 and 55 in the prone position when the table is in the horizontal starting position. The thoracic harness is clipped to two loops 104A and 104C on 104. The pelvic harness is clipped to two loops (not shown) on the foot support 38.

Next, two locking pins 122 are removed from apertures 12A and 91A (see FIG. 5) freeing circular table frame 90 to be rotated about an x axis to bring the table from horizontal to vertical. Once in the vertical position four locking pins 122 are inserted into apertures 86A (not shown) and 86B of vertical bars 86 into apertures 91A (not shown) and 91B of the longitudinal bars of table frame 90. This locks the table frame in the vertical position.

By adjusting the foot support 38, using hand crank 60, and hand pegs 38, using hand crank 40, the patient's torso is then located longitudinally on the table until the table split between sections 104 and 105 is aligned with the section of the spine that is to be tractioned. Necessary adjustments are made in the straps and harnesses until the patient is secure and as comfortable as possible and there is slight tension in the thoracic and pelvic harness. The top half of the table is released from the bottom by removing pin 112 from complementing apertures in one of the sliding runners 110 and corresponding bars 106. It is now free to move away from the bottom when sufficient tension develops in traction cable 80. Cable 80 is now clipped via clip 82 to the center loop 104B of 104.

For correction of conditions where the disc has a lateral pathological component, two pins 122 are removed from apertures 94A and 101 A and 96A and 102A. The table is now free to rotate about it's long axis, either clockwise and counter clockwise within the circular frame. Once the approximate alignment is achieved so that the disc displacement now "appears" as an anterior displacement within the geometry of the system, the pins 122 are reinserted into the appropriate apertures locking outer hoop 94 to inner hoop 101 and outer hoop 96 to inner hoop 102 (see FIG. 7B).

The appropriate weight for traction is determined considering the predetermined treatment centrifuge speed. A pin 123 is placed through the appropriate 70A aperture into it's corresponding weight aperture. This will pin all weights in the stack that are not to slide and contribute to traction force.

At this point everything is in place and treatment is ready to begin. The device is turned on and the power is increased until the desired treatment centrifugal force is achieved. The force of the centrifuge is directly away from the center of rotation. The force vector relative to the patient's body is dependent on the amount of degrees clockwise or counter clockwise the table is fixed within the circular table frame. If the table is positioned with the patients back to the center of rotation the force vector will be directly anterior. This will cause the IVD to be pushed anterior to reduce a posterior derangement. If the table is positioned 45 degrees clockwise, then the force vector will be anterior left. This position could be used to reduce a posterior right lateral derangement.

If the traction feature is employed the weights that are distal to the pin will slide away from the center of rotation as a result of centrifugal force. The weights in turn pull the cable thereby causing the top section of the table to move upwards. This results in a traction force on the vertebra and intervertebral discs of the patient.

If cervical traction is required instead of lumbar traction, a standard occiput-chin harness is incorporated in place of pelvic and chest harnesses. In this case all steps are as above except the cable is attached to the occiput chin harness instead of the top section of the patient securing table. The top and bottom sections of the table remain fixed in position. As the sliding weights move outward in response to the force of the centrifuge, the patient's cervical spine is stretched by the cable and occiput-chin harness in the same manner as described above for lumbar traction.

If it has been determined that traction is not to be used, then all steps are the same except no harnesses are used. All the weights are pinned by placing pin 123 through the appropriate aperture 70A that corresponds to weight 71. The upper half of the table remains fixed to the bottom. Parameters, such as traction force, rotation speed, duration and frequency of treatment, all can be determined with experimentation.

Thus it can be seen that the present invention provides new modalities for the treatment of orthopedic spinal disorders. Centrifugal force can be tailored to the precise requirements of individual patients. In addition centrifugal force can be simultaneously combined with cervical and/or lumbar-sacral traction to further enhance possible treatment benefits. For the purposes of simplicity the centrifugal force device has been described as powered by an electric motor. Obviously other convenient power sources can be utilized to obtain the desired centrifugal forces required. Again, rotating the patient securing table by means of appropriate apertures to obtain desired patient force vectors can obviously be achieved by other methods, including automated rack and pinion devices, and so on. Similarly, means other than weights at one end of a centrifugal device can be used to provide simultaneous centrifugal force and traction to a patient without departing from the disclosure of the invention.

While the present invention has been disclosed in connection with versions shown and described in detail, various modifications and improvements will become readily apparent to those skilled in the art. So, for example, while traction was not disclosed with the first described embodiment, it could be used therewith. So, too, traction need not be utilized with the second version disclosed. Accordingly, the spirit and scope of the present invention is to be limited only by the following claims.

What is claimed is:

1. A method for the treatment of orthopedic spinal pathology utilizing centrifugal force comprising the steps of:

providing a device comprising a lever, a drive motor having a spinning shaft coupled to said lever;

said spinning shaft defining a first vertical rotation axis, a separable table having a flat surface, said table being mounted to one end of the lever, a securing mean for securing the patient to said table;

a) securing the patient to said table;

b) position the table such that the table is perpendicular to the lever;

c) rotating the lever about said first vertical rotational axis; whereby spinning of the shaft causing the lever to spin and resulting in the table being spun about the rotational axis; and d) controlling rotation speed of the lever by adjusting the speed of the drive motor applying centrifugal force to the patient's spine.

2. A method for the treatment of orthopedic spinal pathology utilizing centrifugal force comprising the steps of:

providing a device comprising a lever, a drive motor having a spinning shaft coupled to said lever;

said spinning shaft defining a first vertical rotation axis, a separable table having a flat surface, said table being mounted to one end of tie lever, a securing means for securing the patient to said table, a means for rotating said table about a second vertical axis situated at predetermined distance from and parallel to the first vertical rotational axis a predetermined number of degrees in a clockwise or counter clock direction, a means of locking the table in position about the second vertical axis;

a) securing the patient to said table;

b) positioning the table such that the table is perpendicular to the lever;

c) rotating the table about second vertical axis clockwise or counter clockwise to a predetermined position;

d) locking the table in position about second vertical axis;

e) rotating the lever about said first vertical rotational axis; whereby spinning of the shaft causing the lever to spin and resulting in the table being spin about the first vertical rotational axis; and f) controlling rotation speed of the lever by adjusting the speed of the drive motor applying centrifugal force to the patients spine.

3. A method for the treatment of orthopedic spinal pathology combining centrifugal force and lumbar traction comprising the steps of:

providing a device comprising a lever, a drive motor having a spinning shaft coupled to said lever;

said spinning shaft defining a first vertical rotation axis, a separable table having an upper portion and a lower portion, said table having a flat upper surface, said table being mounted to one end of the lever, a securing means for securing the patient to said table, and a traction mechanism comprising a weight stack, a cable and a pulley system for separating the table portions and applying traction force to the patient;

a) securing the patient to said table;

b) positioning the table such that the table is perpendicular to the lever;

c) rotating the lever about said first vertical rotational axis; whereby spinning of the shaft causing the lever to spin and resulting in the table being spun about the first vertical rotational axis;

d) controlling rotation speed of the lever by adjusting the speed of the drive motor; and e) separating the upper and lower portions of the table by said weight stack and cable and pulley system to simultaneously apply traction and centrifugal force to the patient's spine, the traction force being supplied through the sliding weight stack which converts the centrifugal force applied to the weight stack, to a traction force through the cable-pulley system, one end of the cable being connected to the weight stack and the other to the upper portion of the table, thus allowing the upper portion of the table to be pulled away from the lower portion of the table.

4. A method for the treatment of orthopedic spinal pathology combining centrifugal force and cervical traction comprising the steps of:

providing a device comprising a lever, a drive motor having a spinning shaft coupled to said lever;

said spinning shaft defining a first vertical rotation axis, a separable table having a flat upper surface, said table being mounted to one end of the lever, a securing means for securing the patient to said table, and a traction mechanism, comprising a weight stack, a cable and a pulley system for separating an occiput chin harness and patient's head from the patient's body applying traction force to the patient's cervical spine;

a) securing the patient to said table;

b) securing patient's head in the occiput chin harness;

c) positioning the table such that the table is perpendicular to the lever;

d) rotating the lever about said first vertical rotational axis; whereby spinning of the shaft causing the lever to spill and resulting in the table being spun about the first vertical rotational axis;

e) controlling rotation speed of the lever by adjusting the speed of the drive motor; and f) separating the occiput chin harness secured to the patient's head from the patient's body secured to the table by said weight stack and cable and pulley system to simultaneously apply traction and centrifugal force to the patient's cervical spine, the traction force being supplied through the sliding weight stack which converts the centrifugal force applied to the weight stack, to a traction force through the cable-pulley system, one end of the cable being connected to the weight stack and the other to the occiput chin harness secured to the patient's head, thus allowing the occiput chin harness secured to the patient's head to be pulled away from the patient's body.

5. A method for the treatment of orthopedic spinal pathology combining centrifugal force and lumbar traction comprising the steps of:

providing a device comprising a lever, a drive motor having a spinning shaft coupled to said lever;

said spinning shaft defining a first vertical rotation axis, a separable table having an upper portion and a lower portion, said table having a flat upper surface, said table being mounted to one end of the lever, a securing means for securing the patient to said table, and a traction mechanism comprising a slidable weight stack, a cable and a pulley system for separating the table portions and applying traction force to the patient, a mean for rotating said table about a second vertical axis situated at a predetermined distance from and parallel to the first vertical axis a predetermined number of degrees in a clockwise or counter clock direction, a means of locking the table in position about the second vertical axis;

a) securing the patient to said table;

b) positioning the table such that the table is perpendicular to the lever;

c) rotating the table about second vertical axis clockwise or counter clockwise to a predetermined position;

d) locking the table in position about second vertical axis;

e) rotating the lever about said first vertical rotational axis; whereby spinning of the shaft causing the lever to spin and resulting in the table being spun about the first vertical rotational axis;

f) controlling rotation speed of the lever by adjusting the speed of the drive motor; and g) separating the upper and lower portions of the table by said weight stack and cable and pulley system to simultaneously apply traction and centrifuigal force to the patients spine, the traction force being supplied through the sliding weight stack which converts the centrifugal force applied to the weight stack, to a traction force through the cable-pulley system, one end of the cable being connected to the weight stack and the other to the upper portion of the table, thus allowing the upper portion of the table to be pulled away from the lower portion of the table.

6. A method for the treatment of orthopedic spinal pathology combining centrifugal force and cervical traction comprising the steps of:

providing a device comprising a lever, a drive motor having a spinning shaft coupled to said lever;

said spinning shaft defining a first vertical rotation axis, a separable table having a flat upper surface, said table being mounted to one end of the lever, a securing means for securing the patient to said table, and a traction mechanism comprising a slidable weight stack, a cable and a pulley system for separating an occiput chin harness and patient's head from the patient's body thus applying a traction force to the patient cervical spine, a means for rotating said table about a second vertical axis situated at a predetermined distance from and parallel to the first vertical rotational axis a predetermined number of degrees in a clockwise or counter clock direction, a means of locking the table in position about the second vertical axis;

a) securing the patient to said table;

b) positioning the table such that the table is perpendicular to the lever;

c) rotating the table about second vertical axis clockwise or counter clockwise to a predetermined position;

d) locking the table in position about second vertical axis;

e) securing patients head in the occiput chin harness;

f) rotating the lever about said first vertical rotational axis; whereby spinning of the shaft causing the lever to spin and resulting in the table being spun about the first vertical rotational axis;

g) controlling rotation speed of the lever by adjusting the speed of the drive motor; and h) separating the occiput chin harness secured to the patient's head from the patients body secured to the table, by said weight stack and cable and pulley system to simultaneously apply traction and centrifugal force to the patient's cervical spine, the traction force being supplied through the sliding weight stack which converts the centrifugal force applied to the weight stack, to a traction force through the cable-pulley system, one end of the cable being connected to the weight stack and the other to the occiput chin harness, thus allowing the occiput chin harness secured to the patient's head to be pulled away from the patient's body secured to the table.

* * * * *